US005711371A

United States Patent [19]

Bingham

[11] Patent Number: 5,711,371

[45] Date of Patent: Jan. 27, 1998

[54] DOWN HOLE SUBMERSIBLE PUMP

[76] Inventor: Bill S. Bingham, 70 W. South Park, Broken Arrow, Okla. 74011

[21] Appl. No.: 459,824

[22] Filed: Jun. 2, 1995

[51] Int. Cl.[6] ..... E21B 43/38

[52] U.S. Cl. ..... 166/106; 417/423.3

[58] Field of Search ..... 166/105, 106; 418/48; 417/423.3, 201, 244; 175/107

[56] References Cited

U.S. PATENT DOCUMENTS

| | | | |
|---|---|---|---|
| 3,708,249 | 1/1973 | Luthi | 417/203 |
| 4,086,030 | 4/1978 | David | 417/501 |
| 4,294,573 | 10/1981 | Erickson et al. | 417/89 |
| 4,386,653 | 6/1983 | Drake | 166/105 |
| 4,481,020 | 11/1984 | Lee et al. | 55/203 |
| 4,541,782 | 9/1985 | Mohn | 417/244 |
| 4,741,782 | 5/1988 | Bearden | 415/212 |
| 4,781,531 | 11/1988 | James | 415/212 |
| 4,901,413 | 2/1990 | Cotherman et al. | 29/890.14 |
| 4,913,630 | 4/1990 | Cotheiman et al. | 417/323.3 X |
| 5,101,916 | 4/1992 | Lesh | 175/107 |
| 5,201,848 | 4/1993 | Powers | 415/199.1 |
| 5,363,740 | 11/1994 | Coakley | 91/499 |
| 5,482,117 | 1/1996 | Kolpak et al. | 166/106 X |

*Primary Examiner*—William P. Neuder
*Attorney, Agent, or Firm*—Head, Johnson & Kachigia

[57] ABSTRACT

A down hole submersible pump is attached to the lower end of a tubing string extending to the earth's surface, the pump having a tubular casing connected to the tubing string. A cylinder is rotatably positioned concentrically within the pump casing, the cylinder having an external cylindrical surface in close proximity to the casing internal cylindrical surface and having a spiraled groove formed in the external cylindrical surface. A motor has a drive shaft connected concentrically to the cylinder by which the cylinder is rotated. A fluid inlet is provided between the motor and the cylinder lower end. Fluid is moved by the rotation of the cylinder through the spiral groove formed therein to above the cylinder and thence to the earth's surface through the tubing string.

20 Claims, 2 Drawing Sheets

DOWN HOLE SUBMERSIBLE PUMP

CROSS-REFERENCE TO RELATED APPLICATIONS

This application is not related to any pending patent applications.

CROSS-REFERENCE TO MICROFICHE APPENDIX

This application is not related to any microfiche appendix.

BRIEF SUMMARY OF THE INVENTION

A down hole tubular submersible pump is used for pumping fluid from a subterrain formation through an elongated string of tubing to the earth's surface. At the lower end of the tubing a pump casing is supported, the casing having an internal cylindrical surface. A cylinder is rotatably positioned concentrically within the pump casing. The cylinder has a top and bottom end and an external peripheral surface in closed proximity to the casing internal cylindrical surface. The rotational axis of the cylinder is coincidence with the casing cylindrical axis.

At least one spiral groove is formed in the casing external peripheral surface. The groove extends the full length of the casing from the bottom to the top end. A motor, having a drive shaft, is connected to the cylinder by which the cylinder is rotated, and the motor is supported to the pump casing lower end.

A fluid inlet is provided in the pump casing between the motor and the cylinder lower end. When the cylinder is rapidly rotated, fluid is moved by the rotation of the cylinder by an Archimedean screw action from the fluid inlet through the spiral groove to above the cylinder and from thence the fluid is moved upwardly in the tubing string to the earth's surface.

In a preferred arrangement, the cylinder includes a non-metallic liner.

Bearings are provided above and below the cylinder to maintain it concentrically within the casing.

An important aspect of the invention is the provision of a propeller on the motor shaft immediately below the cylinder. The propeller functions to move fluid from a fluid inlet to the lower end of the cylinder so that the fluid will be caught up in the rotating spiral groove formed on the cylinder and moved to the space above the cylinder from where it is conveyed upwardly in the tubing to the earth's surface.

The specific configuration of the spiral groove in the cylinder is important. The spiral groove is non-symmetrical with reference to a cross-section taken perpendicular of the rotational axis of the cylinder and varies in cross-sectional area from smaller to larger in the direction of rotation. This configuration causes the fluid captured in the groove to be compressed and to more efficiently move upwardly by the rapid rotation of the cylinder.

A better understanding of the invention will be obtaining from the following detailed description of the preferred embodiment, taken in conjunction with the attached drawings.

DESCRIPTION OF THE PREFERRED EMBODIMENTS

Figure 1:
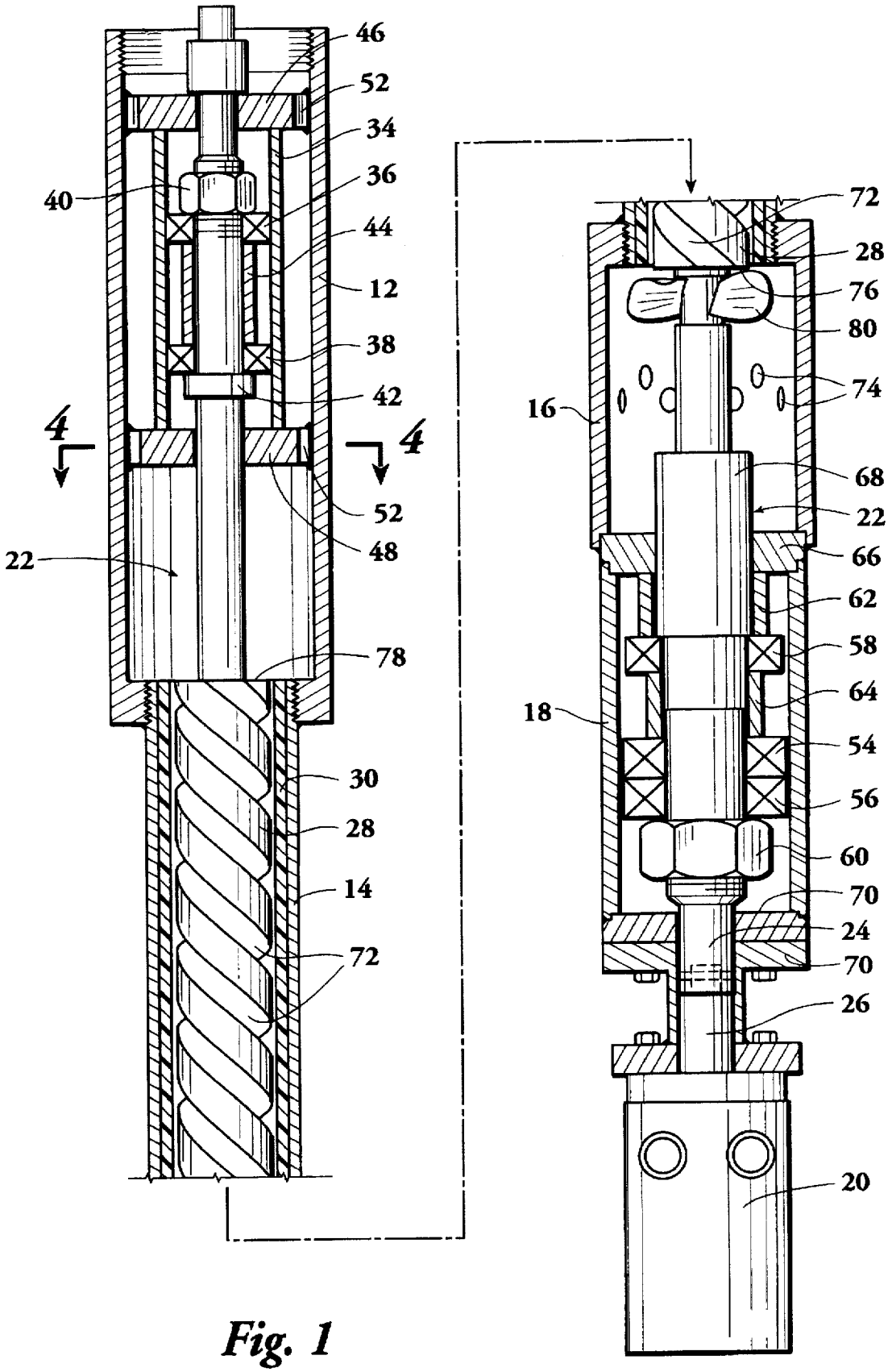
FIG. 1 is an exploded cross-sectional view of a down hole pump that incorporates, the principles of this invention.
Figure 2:
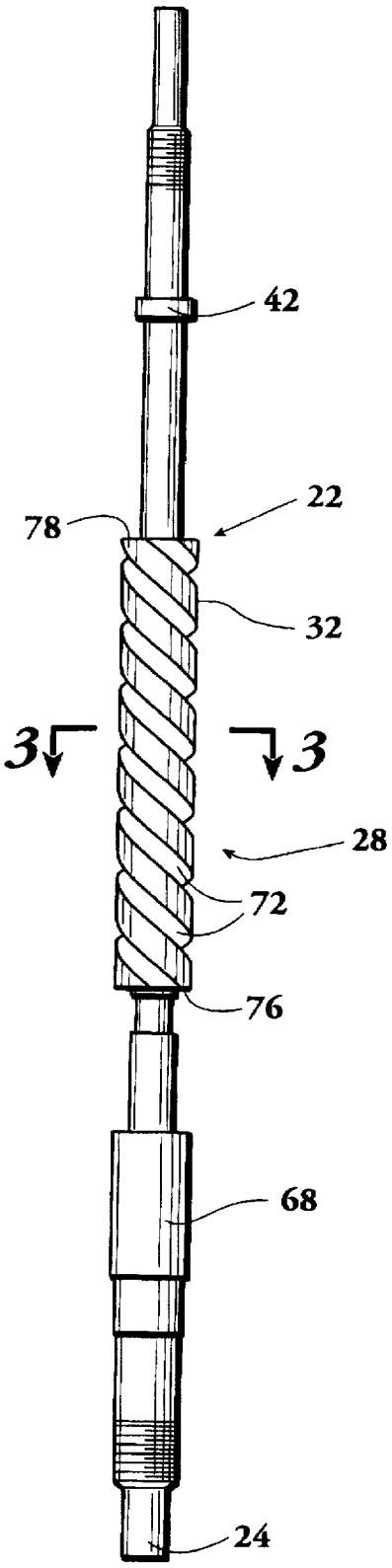
FIG. 2 is a reduced scale elevational external view of the pump shaft having the cylinder formed as a part thereof.

Referring to the drawings and first to FIG. 1, the basic components of the down hole pump of this invention are illustrated. The pump includes, as basic external components, a tubular pump housing 12, a tubular pump casing 14, the upper end of which is threadably attached to the lower end of pump housing 12, an intake housing 16 secured to the lower end of pump casing 14, a bearing housing 18 and a motor 20. Positioned within the housing assembly formed of the pump housing 12, pump casing 14, intake housing 16 and bearing housing 18 is a pump shaft generally indicated by the numeral 22 that is illustrated in FIG. 2. The pump shaft has a lower end 24 that is connected to a motor shaft 26. Thus, when motor 20 is energized the entire pump shaft 22 rotates at a rapid rate.

Secured as an intermediate portion of pump shaft 22 is a cylinder 28 that is closely received within pump casing 14. In the preferred arrangement, a non-metallic liner 30, such as made preferably of Teflon®, is positioned within and secured to the interior of pump casing 14. Cylinder 28 has an external cylindrical surface 32 that closely fits the interior of pump casing 14 or more particularly to the interior cylindrical surface of line 30 when a liner 30 is employed as in the preferred embodiment.

Referring back to FIG. 1, pump housing 12, at the upper end of the assembly, includes a short-length tubular bearing housing 34 that retains bearings 36 and 38 held in place between a nut 40 and spacer 42. A tubular bearing spacer 44 is positioned between bearings 36 and 38 so that the entire assembly accurately and rotatably supports the upper end of pump shaft 22.

Figure 4:
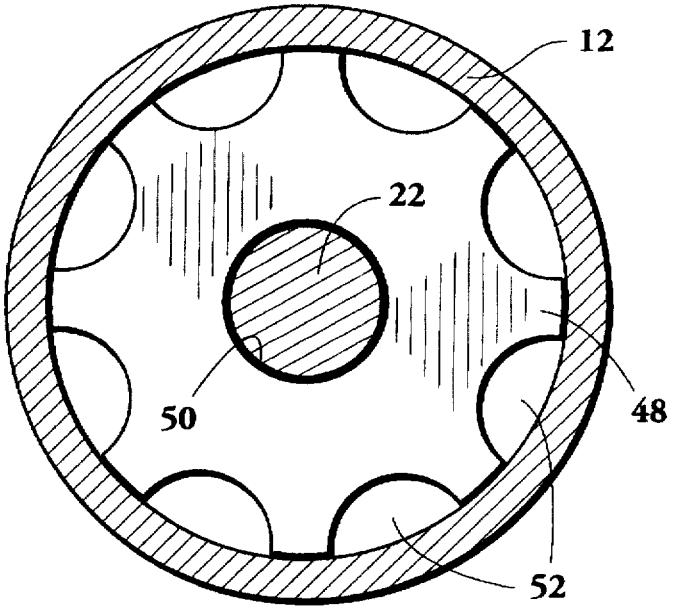
FIG. 4 is a cross-sectional view taken along the line 4—4 of FIG. 1 and showing the configuration of a support plate with ports for passage of the pumped fluid upwardly within the well tubing.

Bearing housing 34 is supported between spacers 46 and 48. The shape of spacer 48 is shown in FIG. 4. Spacer 46 has a corresponding shape. Each spacer has an opening 50 to rotatably receive an upper end portion of pump shaft 22. Further, spacers 46 and 48 each has fluid passageways 52 through which pumped fluid may flow upwardly within the upper end of pump housing 12.

Not shown, but common with all submersible down hole pumps, a string of tubing extends from the earth's surface, the lower end of the string of the tubing being connected to the upper end of pump housing 12. Pumped fluid flowing upwardly through pump housing 12 will flow into a string tubing and, thus, to the earth's surface.

Referring now to the right hand portion of FIG. 1 which shows the lower portion of the pump assembly, bearing housing 18 supports bearings 54, 56 and 58. A nut 60 is threadably received on the motor pump shaft 22. Spacers 62 and 64 retain the bearings in proper position with reference to nut 60. A plate 66 closes the upper end of bearing housing 18 and provides the lower end of intake housing 16. An enlarged diameter portion 68 of pump shaft 22 is rotatably received within an opening formed in plate 66.

Secured to the lower end of bearing housing 18 is a lower plate 70 that rotatably receives the lower end 24 of pump shaft 22. Bearing housing 18 is thus closed at its upper end by plate 66 and its lower end by plate 70 to provide a closed, fluid tight housing in which bearings 54, 56 and 58 are contained.

Thus, it can be seen that bearings within pump housing 12 and pump housing 18 accurately support the upper and lower ends of pump shaft 22 as it is rotated by motor 20.

Important parts of the invention are cylinder 28, pump casing 14 and liner 30. Formed on the external cylindrical surface 32 of cylinder 28 is at least one spiral groove 72. Fluid flows into intake fluid housing 16 through opening 74 therein. The fluid enters spiral groove 72 in cylinder 28 and is moved upwardly within casing 14 by the Archimedean screw principle. Fluid flows within spiral groove 72 at the cylinder bottom end 76 and flows out of groove 72 at the cylinder upper end 78. As the fluid exits spiral groove 76 at cylinder upper end 78, it passes into pump housing 12 and upwardly through the fluid passageways 52 in plates 46 and 48 to enter the lower end of a string of tubing (not shown) and, thus, the fluid is moved to the earth's surface.

As shown in the upper end of the right hand portion of the pump of FIG. 1, affixed to pump shaft 22 immediately below the lower end 76 of cylinder 28 is a propeller 80. The function of propeller 80 is to move fluid from inlet housing 16 aggressively against lower end 76 of cylinder 28. This causes the fluid to enter into groove 72. Once in the groove, the fluid is forced upwardly through the groove and to the earth's surface, as previously described. Thus, propeller 80 that is mounted within intake housing 16 is an important aspect of the invention.

Figure 3:
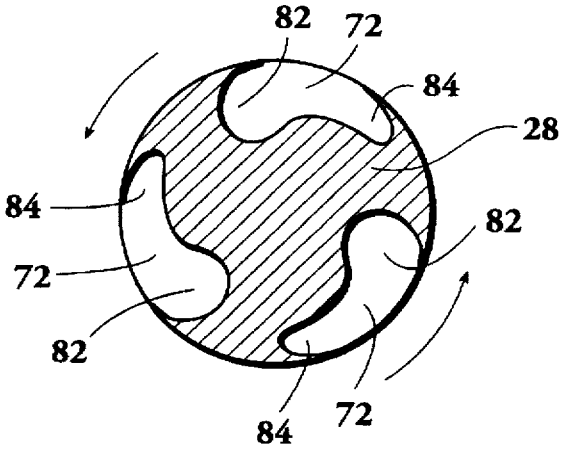
FIG. 3 is a cross-sectional view of the cylinder as taken along the line 3—3 of FIG. 2 showing the cross-sectional shape of spiral grooves formed in the cylinder external surface.

Another important feature of the invention is the configuration of the spiral groove 72 formed in the external surface of cylinder 28, shown in FIG. 3. As previously indicated, the cylinder can accept one or more spirals. In the embodiment of FIG. 3, the cylinder has three spaced apart spiral grooves each of which uninterruptedly extends from cylinder bottom 76 to top 78. Further, as seen in FIG. 3, the cross-sectional configuration of each of the spiral grooves 72 is non-symmetrical. That is, each of the groove 72 is not merely U-shaped, but includes a cross-sectional shape having, in the direction of rotation of the cylinder, an enlarged area portion 82 followed by a smaller area portion 84. The cross-sectional configuration of the groove tapers to a reduced cross-sectional. The streamlined cross-sectionally tapered grooves in the cylinder capture fluid as the cylinder is rapidly rotated and moves the fluid upwardly through the pump for discharge into a connecting tubing stream.

The pump defined herein has advantages over other types of down hole pumps. First, compared to a progressing cavity pump, the pump of this invention does not require direct contact between rotating cylinder 28 and liner 30. All that is required is a very close fit between these two components. Therefore, wear is reduced and longer pump life is achieved. Further, the pump described herein does not rely upon centrifugal force to move fluid, as does a centrifugal pump commonly employed as a bottom hole pump for moving fluid from a subterrean formation.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A down hole submersible pump for attachment to the lower end of a string of tubing extending to the earth's surface comprising:

a tubular pump casing having an upper end, a lower end and an internal cylindrical surface;

means connecting said pump casing upper end to said tubing string lower end;

a cylinder rotatably positioned concentrically within said pump casing, the cylinder having a top and bottom end, an external peripheral surface in close proximity to said casing internal cylindrical surface and a cylindrical axis, at least one spiraled groove being formed in said external peripheral surface extending the full length thereof;

a motor having a drive shaft connected concentrically to said cylinder by which said cylinder is rotated;

means supporting said motor to said pump casing lower end;

fluid inlet means in said pump casing between said motor and said cylinder lower end, fluid being moved by the rotation of said cylinder from said fluid inlet through said at least one spiral grove to above said cylinder and thence to the earth's surface when said cylinder is rotated by said motor; and a propeller positioned on said drive shaft adjacent to and below said cylinder lower end.

2. A down hole pump according to claim 1 including:

a non-metallic liner received within said tubular pump casing and receiving said cylinder.

3. A down hole pump according to claim 1 including:

an upper shaft extending concentrically from said cylinder upper end; and a bearing means supported by said pump casing and receiving said upper shaft, and means for passage of fluid therepast.

4. A down hole pump according to claim 1 wherein each said spiral groove is, in a cross-section normal to said cylindrical axis, non-symmetrical in configuration.

5. A down hole pump according to claim 4 in which each said groove in cross-section is, in the direction of rotation of said cylinder, of a larger to a smaller cross-sectional area.

6. A pump for moving a liquid comprising:

a tubular pump casing having a first end and a second end and an internal cylindrical surface;

a cylinder rotatably positioned concentrically within said casing, the cylinder having an external cylindrical surface in close proximity to said casing internal cylindrical surface and having at least one spiral groove formed in said external cylindrical surface;

a motor having a drive shaft connected concentrically to said cylinder by which said cylinder is rotated;

means supporting said motor to said casing first end;

a fluid inlet in said casing between said motor and said cylinder, fluid being moved by the rotation of said cylinder from said fluid inlet through said at least one spiral groove and out said casing second end; and a propeller positioned on said drive shaft adjacent to and below said cylinder lower end.

7. A down hole pump according to claim 6 including:

a non-metallic liner received within said tubular pump casing and receiving said cylinder.

8. A down hole pump according to claim 6 including:

an upper shaft extending concentrically from said cylinder upper end; and a bearing means supported by said pump casing and receiving said upper shaft, and means for passage of fluid therepast.

9. A down hole pump according to claim 6 wherein each said spiral groove is, in a cross-section normal to said cylindrical axis, non-symmetrical in configuration.

10. A down hole pump according to claim 9 in which each said groove in cross-section is, in the direction of rotation of said cylinder, of a larger to a smaller cross-sectional area.

11. A down hole submersible pump for attachment to the lower end of a string of tubing extending to the earth's surface comprising:

a tubular pump casing having an upper end, a lower end and an internal cylindrical surface;

means connecting said pump casing upper end to said tubing string lower end;

a cylinder rotatably positioned concentrically within said pump casing, the cylinder having a top and bottom end, an external peripheral surface in close proximity to said casing internal cylindrical surface and a cylindrical axis, at least one spiraled groove being formed in said external peripheral surface extending the full length thereof, each spiral groove being, in a cross-section normal to said cylindrical axis, non-symmetrical in configuration;

a motor having a drive shaft connected concentrically to said cylinder by which said cylinder is rotated;

means supporting said motor to said pump casing lower end; and fluid inlet means in said pump casing between said motor and said cylinder lower end, fluid being moved by the rotation of said cylinder from said fluid inlet through said at least one spiral grove to above said cylinder and thence to the earth's surface when said cylinder is rotated by said motor.

12. A down hole pump according to claim 11 including:

a non-metallic liner received within said tubular pump casing and receiving said cylinder.

13. A down hole pump according to claim 11 including:

an upper shaft extending concentrically from said cylinder upper end; and a bearing means supported by said pump casing and receiving said upper shaft, and means for passage of fluid therepast.

14. A down hole pump according to claim 11 including:

a propeller positioned on said drive shaft adjacent to and below said cylinder lower end.

15. A down hole pump according to claim 11 in which each said groove in cross-section is, in the direction of rotation of said cylinder, of a larger to a smaller cross-sectional area.

16. A pump for moving a liquid comprising:

a tubular pump casing having a first end and a second end and an internal cylindrical surface;

a cylinder rotatably positioned concentrically within said casing, the cylinder having a cylindrical axis and an external cylindrical surface in close proximity to said casing internal cylindrical surface and having at least one spiral groove formed in said external cylindrical surface, each spiral groove being, in a cross-section normal to said cylindrical axis, non-symmetrical in configuration;

a motor having a drive shaft connected concentrically to said cylinder by which said cylinder is rotated;

means supporting said motor to said casing first end; and a fluid inlet in said casing between said motor and said cylinder, fluid being moved by the rotation of said cylinder from said fluid inlet through said at least one spiral groove and out said casing second end.

17. A down hole pump according to claim 16 including:

a non-metallic liner received within said tubular pump casing and receiving said cylinder.

18. A down hole pump according to claim 16 including:

an upper shaft extending concentrically from said cylinder upper end; and a bearing means supported by said pump casing and receiving said upper shaft, and means for passage of fluid therepast.

19. A down hole pump according to claim 16 including:

a propeller positioned on said drive shaft adjacent to and below said cylinder lower end.

20. A down hole pump according to claim 16 in which each said groove in cross-section is, in the direction of rotation of said cylinder, of a larger to a smaller cross-sectional area.

* * * * *